United States Patent [19]

Harrell et al.

[11] 4,191,529

[45] Mar. 4, 1980

[54] FURNACE FOR HEATING SOLIDS

[75] Inventors: John B. Harrell, Pittsburgh; William F. Barraclough, Corapolis, both of Pa.; Curtis O. Pederson, Urbana, Ill.

[73] Assignee: Salem Furnace Co., Pittsburgh, Pa.

[21] Appl. No.: 950,455

[22] Filed: Oct. 11, 1978

[51] Int. Cl.[2] ..... F27B 1/20

[52] U.S. Cl. ..... 432/98; 414/172; 414/187; 414/588; 432/100; 432/151; 432/239

[58] Field of Search ..... 432/96, 98, 100, 151, 432/139, 239; 414/172, 187, 210, 211, 588

[56] References Cited

U.S. PATENT DOCUMENTS

| | | | |
|---|---|---|---|
| 850,039 | 4/1907 | McKnight | 432/98 |
| 2,660,966 | 12/1953 | Lyons | 432/239 |

FOREIGN PATENT DOCUMENTS 641787 2/1937 Fed. Rep. of Germany .

*Primary Examiner*—John J. Camby

*Attorney, Agent, or Firm*—Buell, Blenko & Ziesenheim

[57] ABSTRACT

The furnace is circular in plan and comprises an annular charge space charged through chutes in its top wall. Effluent gas offtakes are provided in the furnace outer wall and the level of the charge bed is maintained above the chute bottoms but below those offtakes. Hot gases generated externally of the furnace pass into it through an opening in its bottom wall or hearth and travel upwardly through the charge. Solids are discharged downwardly through the same opening in counterflow. A vertical axle is journalled centrally in an upper wall of the annular furnace chamber spaced above the opening in the hearth, and a plow affixed to the lower end of the axle rotates in an open space between the hearth of the annular furnace chamber and its inside wall, so scraping heated charge solids into the discharge opening. The axle is pressure sealed to the wall through which it passes, and that seal is the only rotating seal required for the furnace.

6 Claims, 2 Drawing Figures

FURNACE FOR HEATING SOLIDS

This invention relates to heating or pre-heating furnaces for granular or other discrete solids. It is more particularly concerned with such furnaces which are sealed to the outside atmosphere.

Granular solids are conventionally heated or pre-heated prior to smelting in furnaces of various types, of which rotary hearth furnaces are well-known. Such furnaces are not well adapted for sealing because the furnaces must be sealed around the peripheries of their hearths and it is difficult to provide such extensive seals which will hold against the pressures developed by large gas volumes. It is a principal object of our invention to provide a heating furnace for such solids which is readily sealed. It is another object to provide a furnace with a minimum of sealing means between rotating and stationary members. Other objects of our invention will appear in the course of the description thereof which follows.

Our furnace is circular in plan and is charged through one or more chutes in its top wall. Those chutes project a considerable distance downwardly into an annular charge space and the level of the charge bed is maintained above the chute bottoms so as to minimize escape of gases through the chutes. One or more effluent gas offtakes are provided in the furnace outer wall positioned above the charge bed level. The furnace is heated with hot gases generated externally thereof which pass into the furnace through an opening in its bottom wall or hearth and travel upwardly through the charge. The heated solids are discharged downwardly through the same opening in counterflow. A vertical axle is journalled centrally in an upper wall of the annular furnace chamber spaced above the opening in the hearth and a plow is affixed to the lower end of the axle so as to rotate in an open space between the hearth and the upper wall, and scrape heated charge solids into the discharge opening. The axle is pressure sealed to the wall through which it passes and that seal is the only rotating seal required for our furnace.

An embodiment of our invention presently preferred by us is illustrated in the attached figures to which reference is now made.

Figure 1:
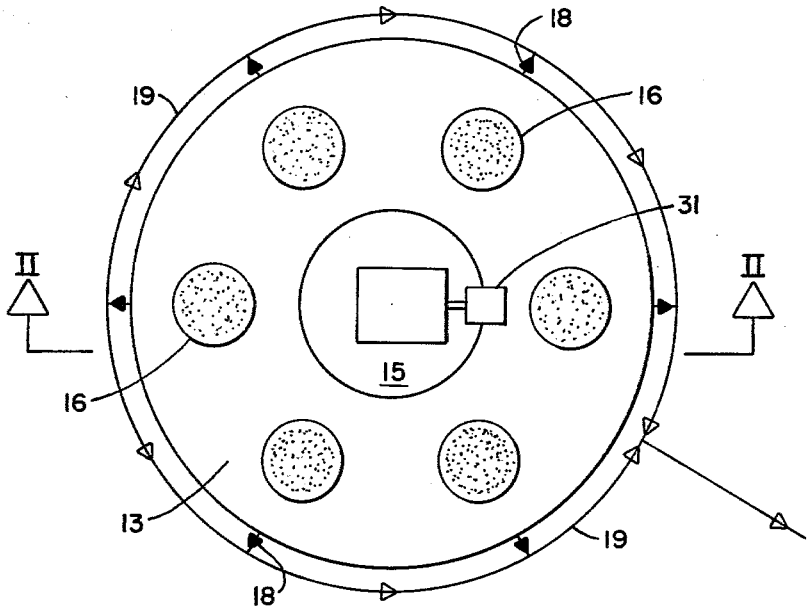
FIG. 1 is a plan of our furnace.
Figure 2:
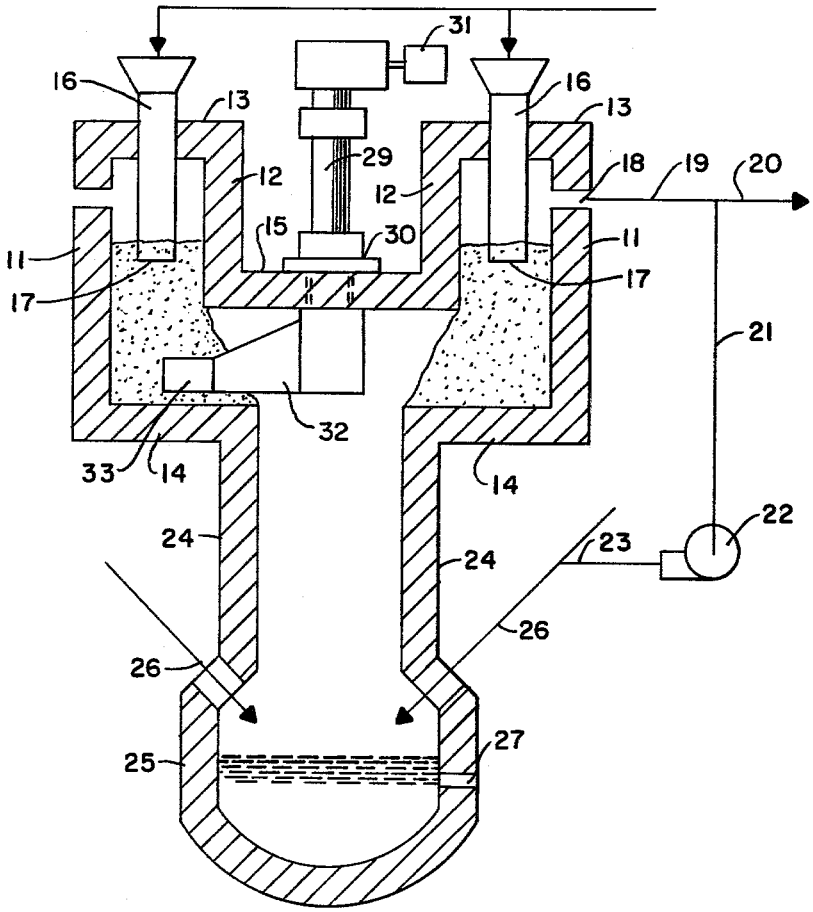
FIG. 2 is an elevation in section taken on the plane II—II of FIG. 1.

The furnace of our invention is shown superimposed on a shaft type melting furnace and will be described in that connection. Our invention, however, is not limited to that combination.

Our furnace comprises an outer cylindrical insulated wall or shell 11 and an inner cylindrical insulated wall 12 coaxial therewith which define an annular space therebetween. That space is covered by an annular top wall 13. Wall 12 is not as deep as wall 11 and the furnace is closed off at the bottom of wall 12 by a circular horizontal wall 15. The bottom of wall 11 meets an annular horizontal bottom wall 14 or hearth, having a central opening somewhat less in diameter than circular wall 15. Around this opening walls 14 and 15 are spaced apart to provide an annular opening out of the annular space between walls 11 and 12.

Spaced around top wall 13 are granular solid feed chutes 16 the lower open ends 17 of which extend a substantial distance into the annular space between walls 11 and 12. Spaced around outer wall 11 intermediate top wall 13 and the lower ends 17 of feed chutes 16 are effluent gas offtakes 18. These connect with a main 19 which is connected to a discharge pipe 20 and to a process gas pipe 21, which in turn connects through a blower 22 with a pipe 23 to be referred to later.

Centrally journalled in wall portion 15 is a vertical axle 29 extending therethrough and sealed thereagainst by rotary seal 30. The upper end of axle 29 is caused to rotate by motor 31. The lower end of axle 29 carries an arm 32 with a plow 33 at its free end which plow rotates in the space between walls 14 and 15.

The discharge opening in wall 14 forms the upper end of a shaft melting furnace 24 terminating at its lower end in a crucible 25. Heating elements 26 project heat into the crucible 25 near its junction with shaft 24 and pipe 23 previously mentioned and simultaneously introduce process gas from pipe 23 into crucible 25 through elements 26. Crucible 25 is formed with a tap hole 27 normally closed by a conventional stopper rod. Heating elements 26 are preferably electric arc heaters, which produce very high temperatures in their arcs.

The operation of our furnace will be set out in connection with its embodiment above described. The solids to be heated are charged into the furnace through the several chutes 16, in the form of granules, pellets or briquettes. The level of the solids in the furnace is maintained below the effluent gas offtakes 18 as will be described. Some of the effluent gas is used as process gas and is supplied, along with other fuels, if required, to heating elements 26 in crucible 25. The gas mix is adjusted to provide oxidizing or reducing atmosphere in shaft 24 as may be required. Rising hot gases in shaft 24 flow upwardly through the charged solids. Axle 29 is rotated by motor 31 at a speed such that plow 33 scrapes heated solids into shaft 24 at a rate equal to the rate of feed into chutes 16, thus maintaining constant the level of the charge in the annular furnace space between walls 11 and 12. The descending solids in shaft 24 meet the rising hot gas countercurrently. Small particles which are elutriated from the falling solids are carried back upwardly by the rising gas stream and are trapped in the packed bed of solids.

It will be evident that the large cross sectional area of the granular bed reduces the velocity of the effluent gases and that good heat exchange is achieved by passing the hot gases through the bed of solids. The only seal required is that around the axle of the slowly rotating plow. Thus, our furnace can be operated at relatively high pressures.

In the foregoing specification we have described presently preferred embodiments of our invention; however, it will be understood that our invention can be otherwise embodied within the scope of the following claims.

We claim:

1. A furnace for transferring heat to divided solids, comprising an annular heating chamber having inner and outer walls and a discharge opening around the lower end of its inside wall, a plow arm affixed to a central vertical axle positioned to rotate within the said discharge opening and plow heated divided solids therethrough, heating elements positioned below said discharge opening, an effluent gas offtake in the upper portion of the annular chamber, divided solids feeding chutes positioned in the upper portion of the annular chamber extending into the chamber to a level below the effluent gas offtake, and means connected with the central vertical axle for rotating the axle.

2. The furnace of claim 1 in which the means for rotating the central vertical axle are positioned outside the heating furnace.

3. The furnace of claim 2 in which the central vertical axle projects through a furnace wall and including means disposed around the central vertical axle for sealing that axle to the furnace wall against pressure developed in the furnace.

4. The furnace of claim 1 in which the divided solids feeding chutes are positioned in the top wall of the annular heating chamber.

5. The furnace of claim 1 in which the effluent gas offtake is positioned in the outer wall of the annular heating chamber.

6. The furnace of claim 1 including means connected with the effluent gas offtake for recirculating at least a portion of the effluent gas into the discharge opening countercurrent to the heated divided solids plowed therethrough.

* * * * *